US009995189B2

(12) United States Patent
Yamazaki et al.

(10) Patent No.: US 9,995,189 B2
(45) Date of Patent: Jun. 12, 2018

(54) ENGINE DRIVEN WORKING MACHINE

(71) Applicant: YAMABIKO CORPORATION, Ohme (JP)

(72) Inventors: Takahiro Yamazaki, Ohme (JP); Ken Shirai, Ohme (JP); Shunsuke Ueda, Ohme (JP); Kenta Ito, Ohme (JP)

(73) Assignee: YAMABIKO CORPORATION, Ohme-Shi, Tokyo (JP)

( * ) Notice: Subject to any disclaimer, the term of this patent is extended or adjusted under 35 U.S.C. 154(b) by 7 days.

(21) Appl. No.: 15/209,904

(22) Filed: Jul. 14, 2016

(65) Prior Publication Data

US 2017/0030232 A1 Feb. 2, 2017

(30) Foreign Application Priority Data

Jul. 29, 2015 (JP) ..... 2015-149752

(51) Int. Cl.

| | |
|---|---|
| ***F01M 5/00*** | (2006.01) |
| ***F01P 1/06*** | (2006.01) |
| ***F02B 63/02*** | (2006.01) |
| ***F01M 1/02*** | (2006.01) |
| *F01P 5/02* | (2006.01) |

(52) U.S. Cl.

CPC ..... *F01M 5/002* (2013.01); *F01M 1/02* (2013.01); *F01P 1/06* (2013.01); *F02B 63/02* (2013.01); *F01P 5/02* (2013.01)

(58) Field of Classification Search

CPC . F01M 5/002; F01M 1/02; F02B 63/02; F01P 1/06; F01P 5/02

USPC ..... 123/41.7, 41.56, 41.65

See application file for complete search history.

(56) References Cited

U.S. PATENT DOCUMENTS

| | | | | |
|---|---|---|---|---|
| 4,932,366 | A * | 6/1990 | Zerrer | B25F 5/008 123/41.58 |
| 5,029,393 | A * | 7/1991 | Nagashima | B27B 17/00 30/381 |
| 8,646,418 | B2 | 2/2014 | Nakamura et al. | |
| 2004/0206312 | A1 | 10/2004 | Liu et al. | |
| 2006/0185628 | A1 | 8/2006 | Akaike et al. | |
| 2011/0308485 | A1 | 12/2011 | Nakamura et al. | |
| 2012/0011730 | A1 * | 1/2012 | Nakamura | F01P 5/06 30/277.4 |

FOREIGN PATENT DOCUMENTS

| | | | |
|---|---|---|---|
| EP | 2 397 665 | A1 | 12/2011 |
| JP | 8-210134 | | 8/1996 |
| JP | 11236819 | A * | 8/1999 |

OTHER PUBLICATIONS

European Search Report issued in European Patent Application No. 16179599.2 dated Dec. 9, 2016.

* cited by examiner

*Primary Examiner* — Hung Q Nguyen
(74) *Attorney, Agent, or Firm* — Baker & Hostetler LLP

(57) ABSTRACT

An engine-driven working machine has an engine unit, a housing, and a vaned rotor. An air passage is defined between a crankcase of the engine unit and a bottom wall of the housing. The air passage has an inlet opening provided near an oil seal on a drive-side shaft, and an outlet opening provided in a magnet-side wall so as to face the vaned rotor. Rotations of the vaned rotor cause airflow from the inlet opening through the air passage to the outlet opening.

7 Claims, 5 Drawing Sheets

ENGINE DRIVEN WORKING MACHINE

FIELD OF THE INVENTION

The present invention relates to an engine-driven working machine, more specifically, to an engine-driven working machine having a function of cooling oil seals of an engine unit.

BACKGROUND OF THE INVENTION

An engine unit of a conventional engine-driven working machine has a crankcase and a crankshaft, and the crankshaft includes a drive-side shaft extending from a drive side of the crankcase and a magnet-side shaft extending from a magnet side of the crankcase. Further, oil seals for ensuring airtightness in the engine unit are provided between the crankcase and the drive-side and magnet-side shafts. Further, a vaned rotor (for example, a vaned flywheel) is attached to the magnet-side shaft, and rotations of the vaned rotor cause an airflow for cooling the engine unit (especially a cylinder block with fines in an upper portion of the engine unit) (see, for example, Patent Publication 1).

PRIOR ART PUBLICATION

Patent Publication 1: Japanese Patent Laid-open Publication No. H08-210134

SUMMARY OF THE INVENTION

Since the crankcase around the oil seal on the magnet-side shaft is near the vaned rotor, it is cooled by an airflow caused by rotations of the vaned rotor. On the other hand, it is difficult for the airflow caused by the rotations of the vaned rotor to cool the crankcase around the oil seal on the drive-side shaft on the opposite side of the magnet-side shaft, because it is difficult for the airflow to reach there. Thus, the cooling of the oil seal on the drive-side shaft generally depends on contact with an external air. However, when there are few chances to contact the oil seal with the external air, for example, when the crankcase around the oil seal on the drive-side shaft is covered by a cover, a temperature of the oil seal becomes high and easy to deform. The deformation of the oil seal cannot maintain the airtightness in the engine unit and may cause an engine stall. Especially, when an oil pump or a recoil case is attached onto the drive-side shaft, the cooling of the oil seal on the drive-side shaft is difficult.

Thus, an object of the present invention is to provide an engine-driven working machine, which can effectively cool the oil seal on the drive-side shaft of the engine unit.

To achieve the above-stated object, an engine-driven working machine according to the present invention has an engine unit, a housing, and a vaned rotor, wherein the engine unit includes a crankcase, a drive-side shaft extending from a drive side of the crankcase, a magnet-side shaft extending from a magnet side of the crankcase, and oil seals sealing between the crankcase and the drive-side and magnet-side shafts, wherein the housing includes a first wall, a second wall disposed adjacent to the drive side of the crankcase, and a third wall disposed adjacent to the magnet side of the crankcase, wherein the vaned rotor is fixed onto the magnet-side shaft extending beyond the third wall and disposed at a location beyond the third wall, wherein an air passage is defined between the crankcase and the first wall, and the air passage has an inlet opening provided near the oil seal on the drive-side shaft, and an outlet opening provided in the third wall so as to face the vaned rotor, and wherein rotations of the vaned rotor cause an airflow flowing from the inlet opening through the air passage to the outlet opening.

In this engine-driven working machine, the rotations of the vaned rotor cause a negative pressure near the outlet opening, and due to a pressure difference between the external air and the negative pressure, can airflow is caused from the inlet opening in the first wall through the air passage to the outlet opening. Since the inlet opening is provided near the oil seal on the drive-side shaft, the airflow flows along the crankcase around the oil seal on the drive-side shaft so that the oil seal can be cooled.

In an embodiment of the engine-driven working machine according to the present invention, preferably, it further has an element which is attached to the second wall and at least partially surrounds the drive-side shaft. The element may be an oil pump or a recoil case.

In this engine-driven working machine, since there are especially few chances of contacting the oil seal on the drive-side shaft with the external air, cooling of the oil seal on the drive-side shaft by the airflow flowing from the inlet opening is more effective.

In an embodiment of the engine-driven working machine according to the present invention, the inlet opening may be provided in the first wall or in the second wall.

In the embodiment in which the inlet opening is provided in the first wall, preferably, the inlet opening is located at the same axial position as that of the oil seal on the drive-side shaft.

In an embodiment of the engine-driven working machine according to the present invention, preferably, the outlet opening is an elongated aperture inclined in the same direction as that of vanes of the vaned rotor.

In this engine-driven working machine, the rotations of the vaned rotor effectively maintain the negative pressure caused near the outlet opening, so that the airflow flowing from the inlet opening of the first wall through the air passage to the outlet opening is effectively caused.

In an embodiment of the engine-driven working machine according to the present invention, preferably, the first wall has a rib arranged near the inlet opening and extending in a direction across the drive-side shaft.

In this engine-driven working machine, since the airflow flowing from the inlet opening is guided and concentrated to a portion of the crankcase around the oil seal by the rib, a cooling effect of the portion can be enhanced. Further, the rib can prevent the airflow flowing from the inlet opening from staying.

As stated above, the engine-driven working machine according to the present invention can effectively cool the oil seal on the drive-side shaft.

DETAILED DESCRIPTION OF EMBODIMENTS

Figure 1:
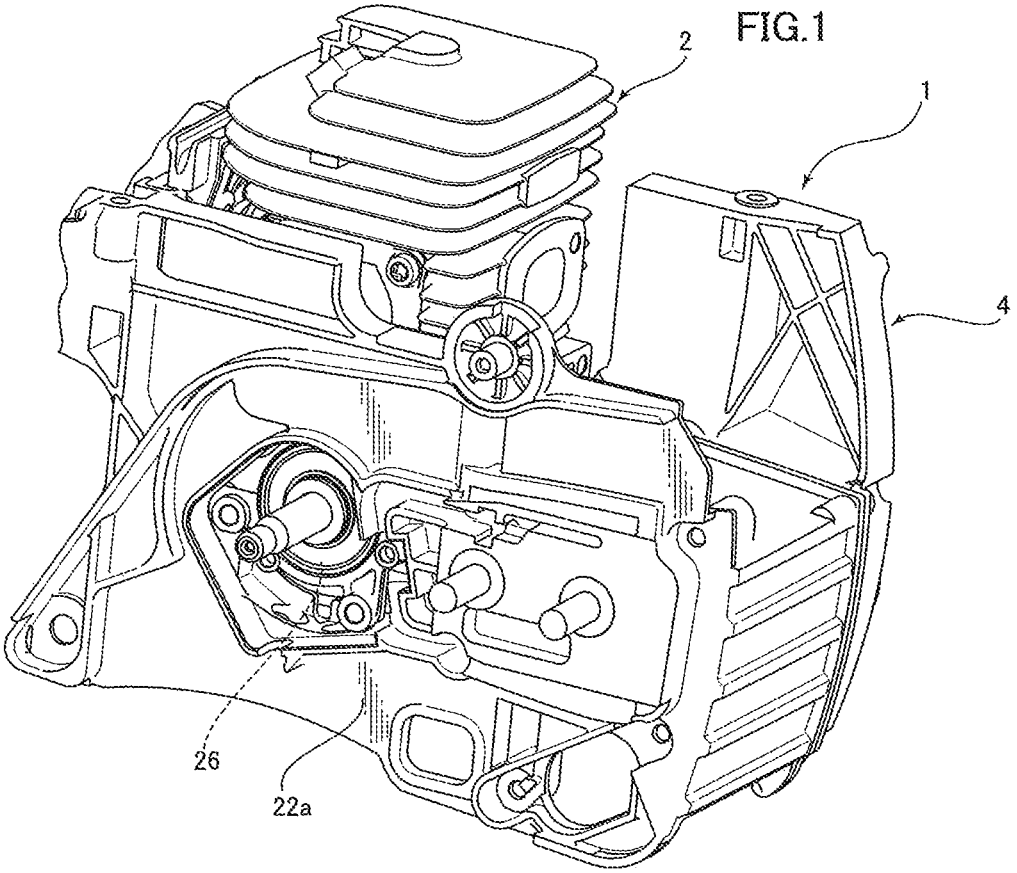
FIG. 1 is a perspective view of an engine-driven working machine according to the present invention, in which the engine-driven working machine is partially omitted.
Figure 5:
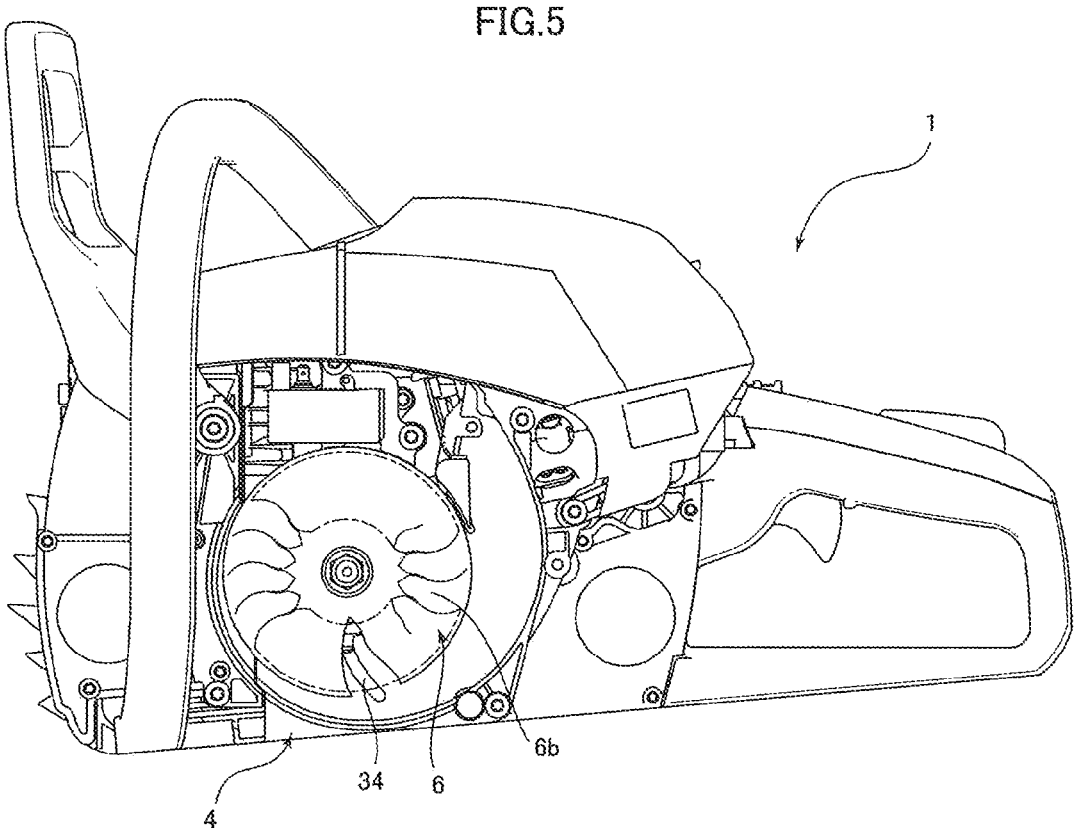
FIG. 5 is a front view of the engine-driven working machine according to the present invention, in which the engine-driven working machine is partially omitted.

As shown in FIGS. 1 and 5, an engine-driven working machine 1 according to the present invention is, for example, a chain saw, and generally has an engine unit 2, a housing 4, and a vaned rotor 6.

Figure 2:
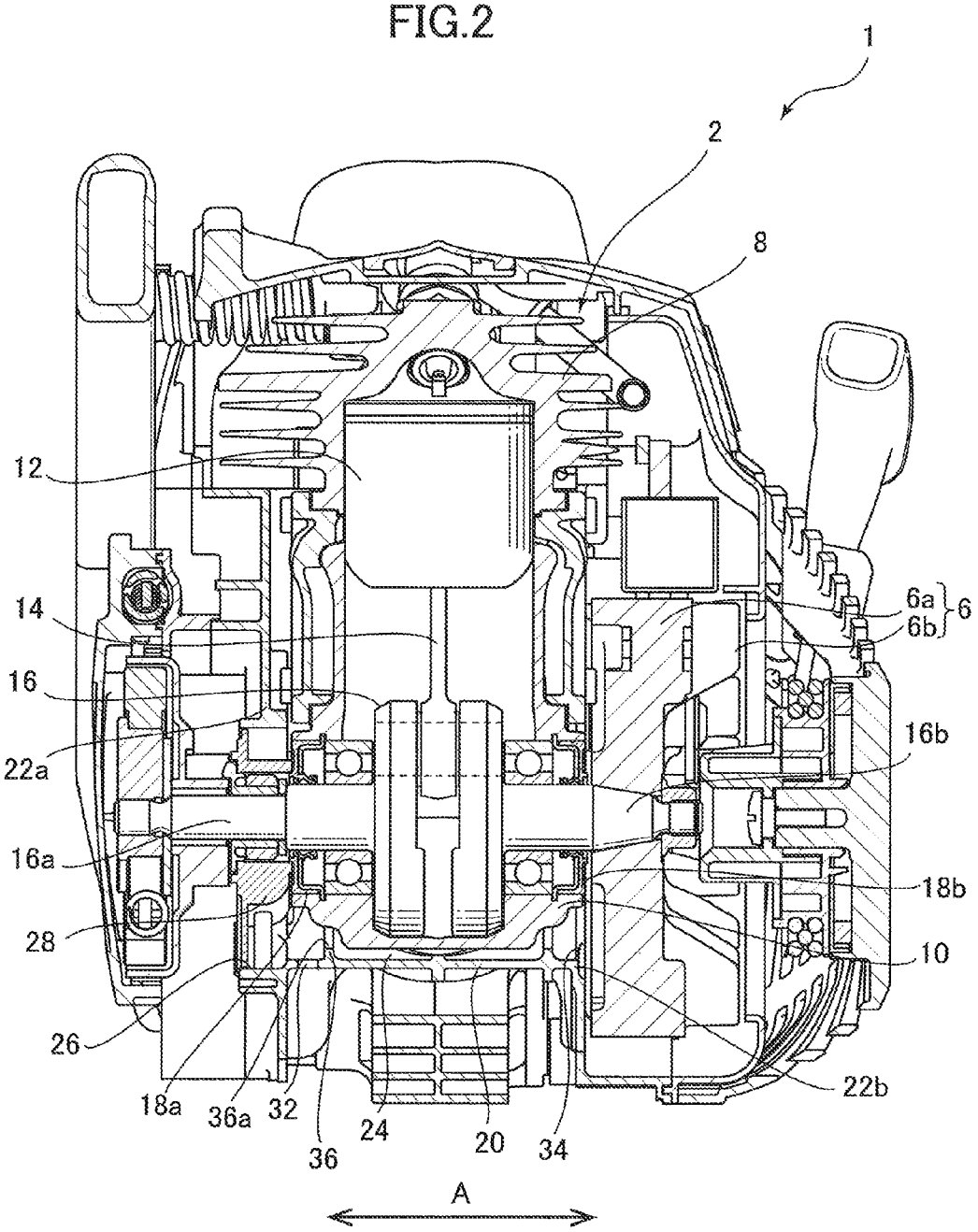
FIG. 2 is a vertical sectional view of the engine-driven working machine according to the present invention.

As shown in FIG. 2, the engine unit 2 includes a cylinder block 8 and a crankcase 10. The engine unit 2 further includes a piston 12, a connecting rod 14, and a crankshaft 16. The crankshaft 16 includes a drive-side shaft 16*a* extending from a drive side of the crankcase 10, and a magnet-side shaft 16*b* extending from a magnet side of the crankcase 10. The drive-side shaft 16*a* and the magnet-side shaft 16*b* extend in an axial direction A. The engine unit 2 further includes a first oil seal 18*a* sealing between the crankcase 10 and the drive-side shaft 16*a*, and a second oil seal 18*b* sealing between the crankcase 10 and the magnet-side shaft 16*b*. A lower surface of the crankcase 10 is curved in a profile so as to define a part of a cylinder about an axis of the shafts 16*a*, 16*b* (not shown).

Figure 3:
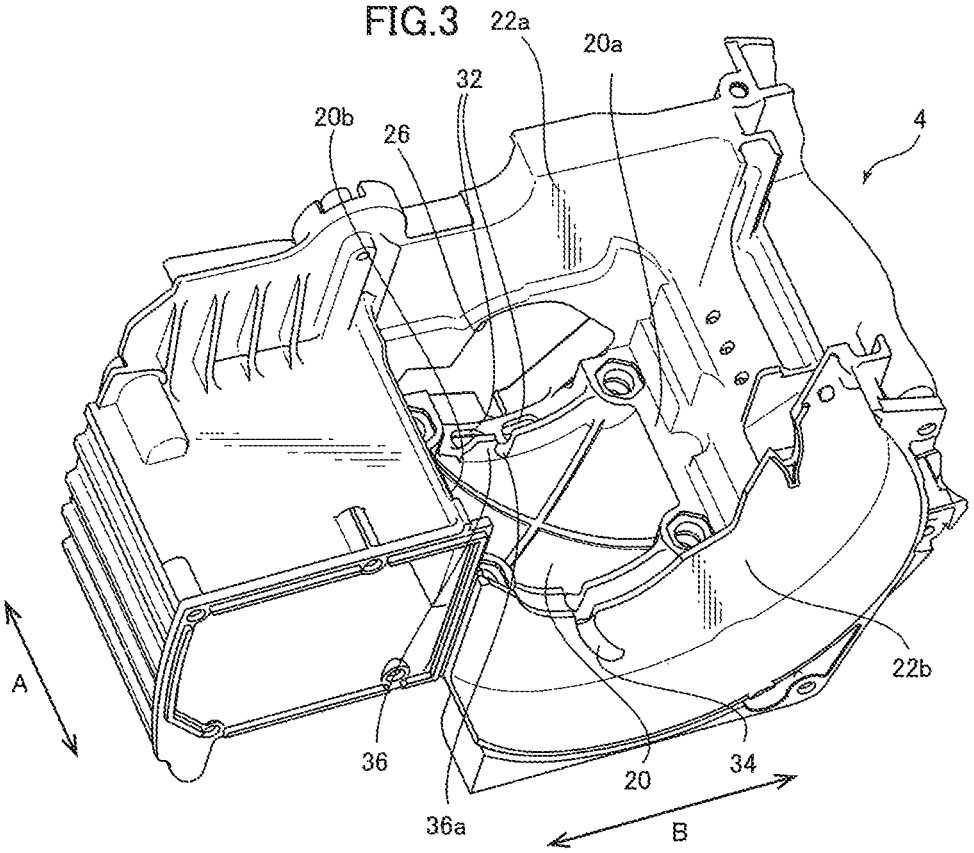
FIG. 3 is a perspective view of a housing of the engine-driven working machine according to the present invention.

As shown in FIGS. 1-3, the housing 4 includes a bottom wall 20 as a first wall, a drive-side wall 22*a* which is provided adjacent to the drive side of the crankcase 10 as a second wall, and a magnet-side wall 22*b* which is provided adjacent to the magnet side of the crankcase 10 as a third wall.

As shown in FIG. 2, the bottom wall 20 is located below the engine unit 2, namely, is disposed so as to face a portion of the crankcase 10 on a side opposite to the cylinder block 8. Further, as shown in FIG. 3, the bottom wall 20 is curved in a profile so as to define a portion of a cylinder around the axis of the shafts 16*a*, 16*b*, and has two attachment surfaces 20*a*, 20*b* onto which the engine unit 2 is attached. Each of the attachment surfaces 20*a*, 20*b* is a ridge portion of the bottom wall 20 and extends in the axial direction A. Further, the attachment surfaces 20*a*, 20*b* are spaced from each other in a direction B perpendicular to the axial direction A. As explained later, when the engine unit 2 is attached onto the attachment surfaces 20*a*, 20*b*, an air passage 24 is caused between the crankcase 10 and the bottom wall 20.

As shown in FIGS. 1-3, the drive-side wall 22*a* extends upward from the bottom wall 20 along the engine unit 2 beyond the drive-side shaft 16*a*. The drive-side wall 22*a* has an aperture 26 through which the drive-side shaft 16*a* passes.

Figure 4:
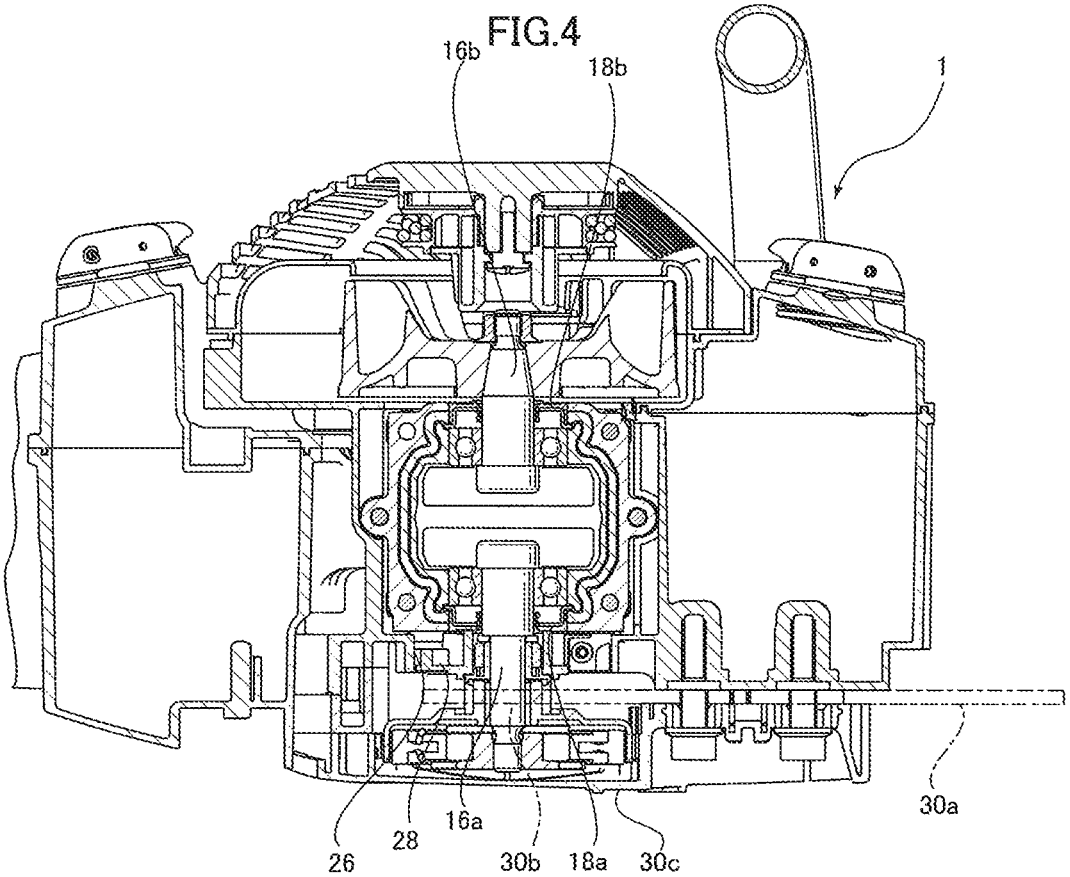
FIG. 4 is a horizontal sectional view of the engine-driven working machine according to the present invention.

As shown in FIGS. 2 and 4, in the present embodiment, the engine-driven working machine 1 further has an oil pump 28 which is an element at least partially surrounding the drive-side shaft 16*a*. The oil pump 28 is attached onto the drive-side wall 22*a* so as to laterally cover the aperture 26, and the drive-side shaft 16*a* extends through the oil pump 28. As shown in FIG. 4, the oil pump 28 is provided for lubrication for a drive part 30*b* of a chain 30*a* of the chain saw, and the drive part 30*b* is sealed with a cover 30*c*.

As shown in FIGS. 2 and 3, the magnet-side wall 22*b* extends from the bottom wall 20 along the crankcase 10 to a position below the magnet-side shaft 16*b*. Namely, the magnet-side wall 22*b* does not cover above the magnet-side shaft 16*b*. This allows the cylinder block 8 of the engine unit 2 to be opened to the vaned rotor 6.

As shown in FIG. 2, the vaned rotor 6 is fixed onto the magnet-side shaft 16*b* extending beyond the magnet-side wall 22*b* and arranged at a position beyond the magnet-side wall 22*b*. The vaned rotor 6 includes a flywheel part 6*a* and a plurality of vanes 6*b* provided on an external surface of the flywheel 6*a*. As shown in FIG. 5, each of the vanes 6*b* has a profile inclined counterclockwise as it goes radially and outwardly in the front view.

As shown in FIG. 2, the air passage 24 is provided between the crankcase 10 and the bottom wall 20. Specifically, when the engine unit 2 is attached onto the attachment surfaces 20*a*, 20*b* which are ridge portions of the bottom wall 20, the crankcase 10 is located above the bottom wall 20. Further, since air neither enters nor exits at the attachment surfaces 20*a*, 20*b*, the air passage 24 extending from the drive side to the magnet side in the axial direction A is defined. The air passage 24 has a profile so as to define a portion of a thin wall cylinder about the axis of the shafts 16*a*, 16*b*.

The air passage 24 has an inlet opening 32 provided in the bottom wall 20 near the oil seal 18*a* on the drive-side shaft 16*a* (see FIG. 3), and an outlet opening 34 in the magnet-side wall 22*b* so as to face the vaned rotor 6 (see FIGS. 3 and 5). Preferably, the inlet opening 32 is located at the same position as that of the oil seal 18*a* on the drive-side shaft 16*a* in the axial direction A. In the present embodiment, the inlet opening 32 is provided below the oil seat 18*a*. In this connection in the present embodiment, the air passage 24 is closed by the drive-side wall 22*a* and the oil pump 28 on the drive side, and substantially closed by the magnet-side wall 22*b* except for the outlet opening 34 on the magnet side.

As shown in FIGS. 2 and 3, the bottom wall 20 has a rib 36 which is near the inlet opening 32 and extend in the direction B perpendicular to the axial direction A (across the drive-side shaft 16*a*). The rib 36 does not contact the crankcase 10, and has a cutout 36*a* for the air passage 24.

The outlet opening 34 is an elongated aperture inclined in the same direction as that of the vanes 6*b* of the vaned rotor 6, and is located below the magnet-side shaft 16*b*. This shape of the elongated aperture helps effectively maintaining a negative pressure caused around the outlet opening 34 due to rotations of the vaned rotor 6 and effectively causing an airflow flowing from the inlet opening 32 in the bottom wall 20 through the an passage 24 to the outlet opening 34. Further, the outlet opening 34 is substantially aligned with the inlet opening 32 in the axial direction A.

Next, an operation of the engine-driven working machine according to the present invention will be explained.

When the engine-driven working machine 1 is operated, the rotations of the vaned rotor 6 make an airflow from the outside toward the cylinder block 8 of the engine unit 2. Thus, a pressure between the magnet-side wall 22*b* and the vaned rotor 6 becomes negative. As a result, an airflow is caused from the inlet opening 32 through the air passage 24 to the outlet opening 34. Since the inlet opening 32 is located near the oil seal 18*a* on the drive-side shaft 16*a*, the airflows along the crankcase 10 around the oil seal 18*a*, so that the oil seal 18*a* can be cooled. Further, since the air entering through the inlet opening 32 is guided and concentrated to the crankcase 10 around the oil seal 18*a* by the rib portion 36, a cooling effect of portion of the crankcase can be enhanced. Further, the rib portion 36 can prevent the air entering through the inlet opening 32 from staying.

This air passage 24 is especially advantageous when the oil pump 28 is attached onto the drive-side wall 22*a* and the drive-side shaft 16*a* extends through the oil pump 28. Specifically, since there is few chance of contact between the oil seal 18*a* on the drive side and an external air due to the oil pump 28 and the cover 30*c*, cooling of the oil seal 18*a* on the drive side by the airflow entering through the inlet opening 32 is effective.

Although an embodiment of the present invention has been explained, the present invention is not limited to the embodiment, namely, many kinds of modifications can be done within the scope of the present invention, and it goes without saying that such modifications fall within the scope of the present invention.

In the above-stated embodiment, the inlet opening 32 is provided below the oil seal 18*a* in the bottom wall 20, but it may be provided obliquely and downwardly or laterally relative to the oil seal 18*a*, so long as the airflow flows along the crankcase 10 around the oil seal 18*a*. Further, the inlet opening 32 is located at the same axial position as that of the oil seal 18*a* on the drive-side shaft 16*a*, but if the airflows along the crankcase 10 around the oil seal 18*a*, the inlet opening 32 may be provided at another position. Further, the number of the inlet openings 32 is arbitrary.

In the above-stated embodiment, the outlet opening 34 is located below the magnet-side shaft 16*b*, but the outlet opening 34 may be located within a right-lower quarter or left-lower quarter relative to the axis of the shafts 16*a*, 16*b* in a circle about the axis of the shafts 16*a*, 16*b* viewed from the front side. Preferably, the outlet opening 34 is located within the left-lower quarter because the negative pressure caused by the rotations of the vaned rotor 6 is relatively high.

In order to effectively cause an airflow flowing from the inlet opening 32 through the air passage 24 to the outlet opening 34, an arrangement of the inlet opening 32 and the outlet opening 34 is preferably so as to align with the axial direction A, but another arrangement may be acceptable if such an airflow is caused.

In the above-stated embodiment, the inlet opening 32 is located in the bottom wall 20, but the inlet opening 32 may be located in the drive-side all 22*a* if the airflow flows along the crankcase 10 around the oil seal 18*a*.

In the above-stated embodiment, the vanes 6*b* are provided on the external side relative to the flywheel part 6*a* (opposite side of the engine unit 2 side), but additional vanes may be provided on an internal side relative to the flywheel part 6*a* so as to positively suction air from the air passage 24.

In the above-stated embodiment, the oil pump 28 is provided as the element attached onto the drive-side wall 22*a* and at least partially surrounding the drive-side shaft 16*a*, but the element may be a recoil starter used when the engine unit 2 is started, or another element.

In the above-stated embodiment, the engine-driven working machine is a chain saw, but it is not limited to the chain saw, namely, it may be another engine-driven working machine. Examples of the engine-driven working machine are, for example, an engine-driven cutter, a trimming machine, a hedge trimmer and a blower.

In the above-stated embodiment, the engine-driven working machine 1 in which the crankcase 10 is located below the cylinder block 8 is explained, but the crankcase 10 may be located obliquely and downwardly or laterally relative to the cylinder block 8.

What is claimed:

1. An engine-driven working machine comprising:

an engine unit comprising a crankcase, a drive-side shaft extending from a drive side of the crankcase, a magnet-side shaft extending from a magnet side of the crankcase, and oil seals sealing between the crankcase and the drive-side and magnet-side shafts;

a housing comprising a first wall, a second wall disposed adjacent to the drive side of the crankcase, and a third wall disposed adjacent to the magnet side of the crankcase; and a vaned rotor fixed onto the magnet-side shaft extending beyond the third wall and disposed at a location beyond the third wall;

wherein an air passage is defined between the crankcase and the first wall, and the air passage has an inlet opening provided near the oil seal on the drive-side shaft and an outlet opening provided in the third wall facing the vaned rotor, and wherein the engine-driven working machine is configured so that rotations of the vaned rotor cause an airflow through the air passage flowing from the inlet opening along the crankcase around the oil seal on the drive-side shaft and through the air passage to the outlet opening.

2. The engine-driven working machine according to claim 1, further comprising an element which is attached to the second wall and at least partially surrounds the drive-side shaft.

3. The engine-driven working machine according to claim 2, wherein the element is an oil pump or a recoil case.

4. The engine-driven working machine according to claim 1, wherein the inlet opening is provided in the first wall or in the second wall.

5. The engine-driven working machine according to claim 1, wherein the inlet opening is provided in the first wall and at the same relative axial position as an axial position of the oil seal on the drive-side shaft.

6. The engine-driven working machine according to claim 1, wherein the outlet opening is an elongated aperture inclined in the same direction as that of a vane of the vaned rotor.

7. The engine-driven working machine according to claim 1, wherein the first wall has a rib arranged near the inlet opening and extending in a direction across the drive-side shaft.

* * * * *